US010741959B2

(12) United States Patent
Uno et al.

(10) Patent No.: US 10,741,959 B2
(45) Date of Patent: Aug. 11, 2020

(54) CONNECTOR

(71) Applicant: Sumitomo Wiring Systems, Ltd., Yokkaichi, Mie (JP)

(72) Inventors: Masafumi Uno, Mie (JP); Hideo Naono, Mie (JP); Masataka Utsunomiya, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/330,146

(22) PCT Filed: Aug. 24, 2017

(86) PCT No.: PCT/JP2017/030269
§ 371 (c)(1),
(2) Date: Mar. 4, 2019

(87) PCT Pub. No.: WO2018/043271
PCT Pub. Date: Mar. 8, 2018

(65) Prior Publication Data

US 2020/0185853 A1 Jun. 11, 2020

(30) Foreign Application Priority Data

Sep. 5, 2016 (JP) ..... 2016-172624

(51) Int. Cl.
*H01R 13/44* (2006.01)
*H01R 13/50* (2006.01)
*H01R 13/627* (2006.01)

(52) U.S. Cl.
CPC ..... *H01R 13/44* (2013.01); *H01R 13/50* (2013.01); *H01R 13/6272* (2013.01)

(58) Field of Classification Search
CPC ..... H01R 13/44
See application file for complete search history.

(56) References Cited

U.S. PATENT DOCUMENTS 4,553,801 A * 11/1985 Zajeski ..... H01R 12/716 439/350
7,311,557 B2 * 12/2007 Oma ..... H01R 13/502 439/358

(Continued)

FOREIGN PATENT DOCUMENTS

JP 2002-56919 2/2002
JP 2006-114287 4/2006

(Continued)

OTHER PUBLICATIONS

International Search Report dated Nov. 14, 2017.

*Primary Examiner* — Ross N Gushi
(74) *Attorney, Agent, or Firm* — Gerald E. Hespos; Michael J. Porco; Matthew T. Hespos

(57) ABSTRACT

A connector 10 disclosed by this specification includes a male connector 20 and a female connector 50 connectable to each other. The male connector 20 includes a male terminal 30 and a male housing 21 having a receptacle 22 and configured to hold the male terminal 30. The female connector 50 includes a female terminal 60 having a connecting portion 61 to be connected to the male terminal 30 and a female housing having a female terminal accommodating portion fittable into the receptacle 22 and configured to hold the female terminal. A protrusion projecting toward the male terminal is provided on an inner surface of the receptacle. The female terminal accommodating portion is provided with a slit into which the protrusion is to be inserted. The connecting portion is provided with an escaping recess configured to allow the protrusion inserted into the slit and projecting inwardly of the female terminal accommodating portion to escape.

3 Claims, 12 Drawing Sheets

(56) References Cited

U.S. PATENT DOCUMENTS

| | | | | |
|---|---|---|---|---|
| 7,686,662 | B2 * | 3/2010 | Schneider | H01R 4/185 439/834 |
| 8,425,248 | B2 * | 4/2013 | Ohsako | H01R 13/6272 439/353 |
| 9,004,954 | B2 * | 4/2015 | Baldwin | H01R 13/46 439/680 |
| 9,065,199 | B2 * | 6/2015 | Mizutani | H01R 24/00 |
| 9,705,229 | B2 * | 7/2017 | Itou | H01R 4/184 |
| 10,170,857 | B2 * | 1/2019 | Ho | H01R 13/6273 |
| 10,498,077 | B2 * | 12/2019 | Ohsako | H01R 12/7011 |
| 2017/0070012 | A1 | 3/2017 | Hiramatsu et al. | |
| 2017/0194740 | A1 | 7/2017 | Nakazawa | |

FOREIGN PATENT DOCUMENTS

| | | |
|---|---|---|
| JP | 2011-119106 | 6/2011 |
| JP | 2015-220169 | 12/2015 |
| JP | 2017-123223 | 7/2017 |

* cited by examiner

CONNECTOR

BACKGROUND

Field of the Invention

This specification relates to a connector.

Related Art

Japanese Unexamined Patent Publication No. 2006-114287 discloses a male connector that includes a male housing and a male terminal fitting accommodated in the male housing. The male housing includes a terminal accommodating portion for accommodating the male terminal fitting and a tubular receptacle formed in front of the terminal accommodating portion. The male terminal fitting includes a fitting portion projecting forward from a back wall of the receptacle. On the other hand, a female terminal fitting to be connected to the male terminal fitting includes a box-shaped connecting portion to be connected to the fitting portion.

Consideration has been given to providing a rib on an inner surface of the receptacle to prevent a finger from contacting the male terminal fitting in the above male connector. By doing so, a finger that enters the receptacle from above contacts the rib, thereby avoiding contact with the male terminal fitting.

However, the connecting portion of the female terminal fitting or a housing accommodating the connecting portion will interfere with the rib provided on the inner surface of the receptacle. Thus, the rib cannot be provided without careful consideration. Accordingly, if the finger contact preventing measure is provided by elongating the receptacle forward instead of providing the rib, the male connector becomes longer in a front-rear direction. Thus, this cannot be said to be a good idea. As just described, a method for providing a rib as a finger contact preventing measure while avoiding the enlargement of a male connector has not been established yet.

SUMMARY

A connector disclosed by this specification has a male connector and a female connector connectable to each other. The male connector includes a male terminal and a male housing having a receptacle and configured to hold the male terminal. The female connector includes a female terminal having a connecting portion to be connected to the male terminal and a female housing having a female terminal accommodating portion that can fit into the receptacle and that is configured to hold the female terminal. A protrusion is provided on an inner surface of the receptacle and projects toward the male terminal. The female terminal accommodating portion is provided with a slit into which the protrusion is to be inserted, and the connecting portion is provided with an escaping recess configured to allow the protrusion inserted into the slit and projecting inwardly of the female terminal accommodating portion to escape.

According to this configuration, the protrusion is on the inner surface of the receptacle. The protrusion interferes with a finger to form a finger contact preventing measure. Further, when the male connector and the female connector are connected, the connectors are connected by the entrance of the protrusion into the slit and the escaping recess. Thus, the finger contact preventing measure can be provided without enlarging the male connector.

The connecting portion may include a rectangular tube and a resilient member disposed inside the rectangular tube. The escaping recess may penetrate through the rectangular tube in a plate thickness direction. According to this configuration, the rectangular tube can be reduced in size as compared to the case where the rectangular tube is provided with a bottomed recess.

The resilient member may include a base plate disposed along an inner surface of the rectangular tube and a spring extending inward of the rectangular tube from the base plate, and the base plate may be disposed in a one-end side opening of the escaping recess. According to this configuration, the protrusion enters the escaping recess, and the base plate prevents the protrusion from contacting the spring. Therefore, the protrusion cannot damage of the spring.

According to the connector disclosed by this specification, the finger contact preventing measure can be provided without enlarging the male connector.

DETAILED DESCRIPTION

Figure 1:
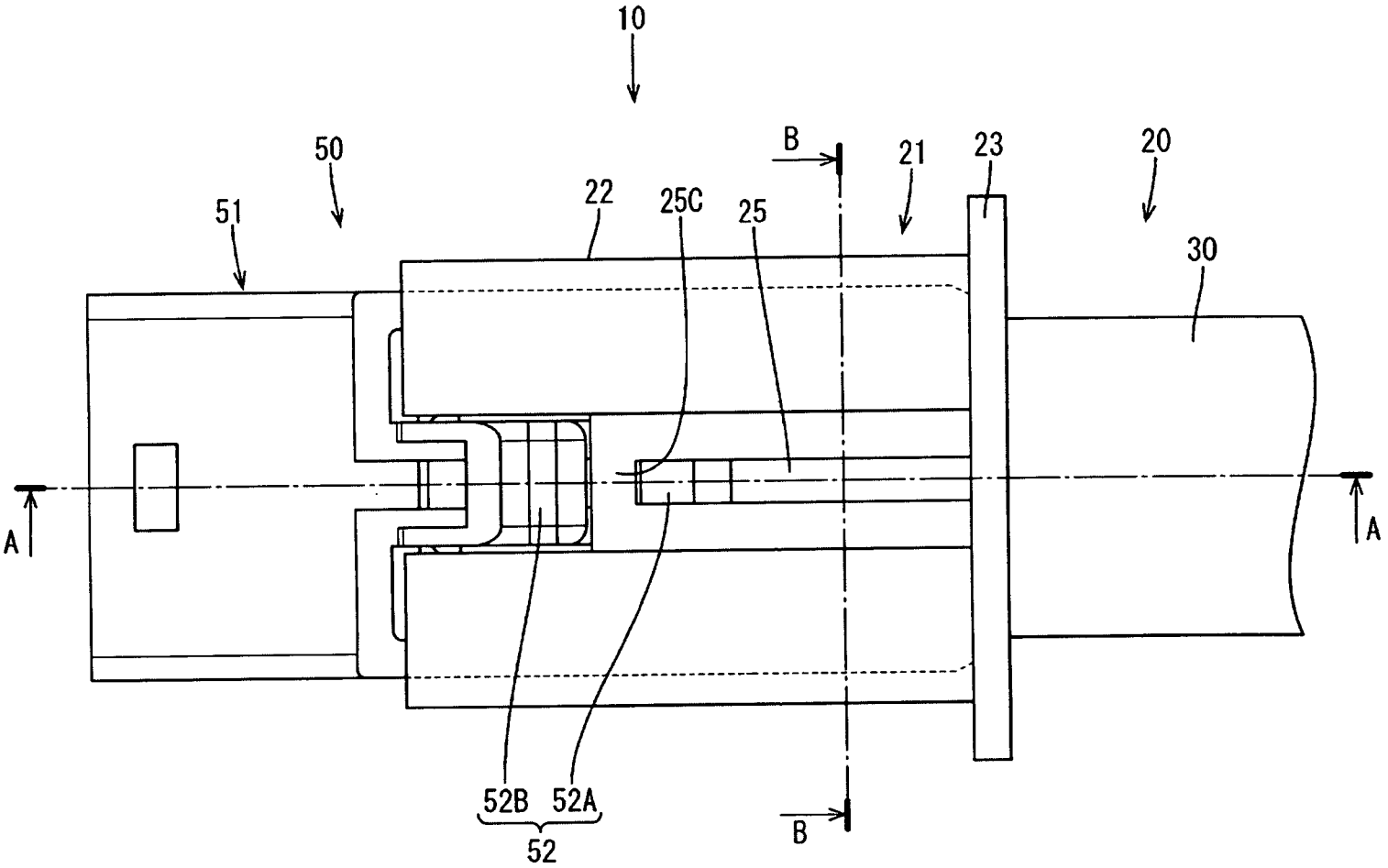
FIG. 1 is a plan view of a connector.
Figure 2:
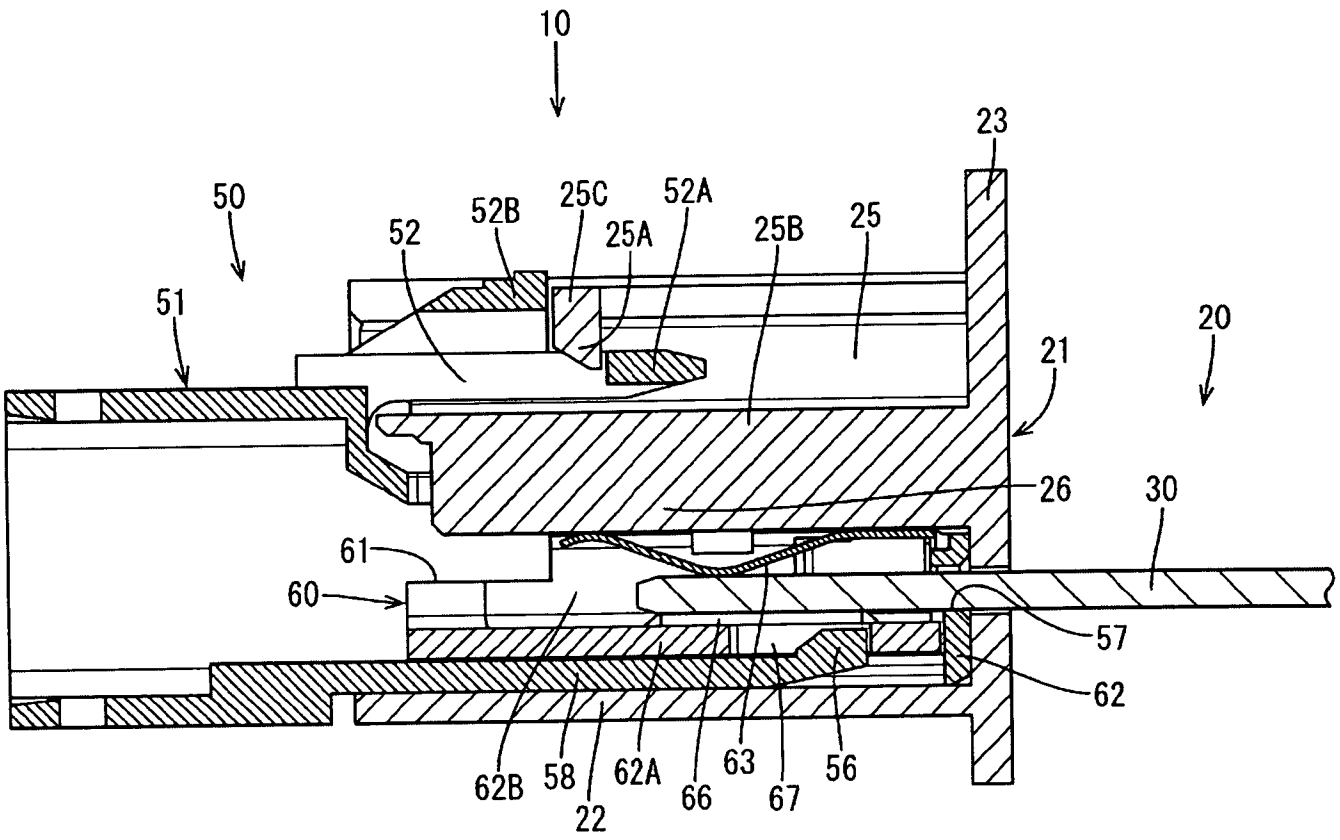
FIG. 2 is a section along A-A in FIG. 1.

An embodiment is described with reference to FIGS. 1 to 14. A connector 10 in this embodiment includes a male connector 20 and a female connector 50 connectable to each other as shown in FIGS. 1 and 2. In the following description, a connecting direction of the male connector 20 and the female connector 50 is referred to as a front-rear direction and connection surface sides thereof are referred to as front sides.

Figure 8:
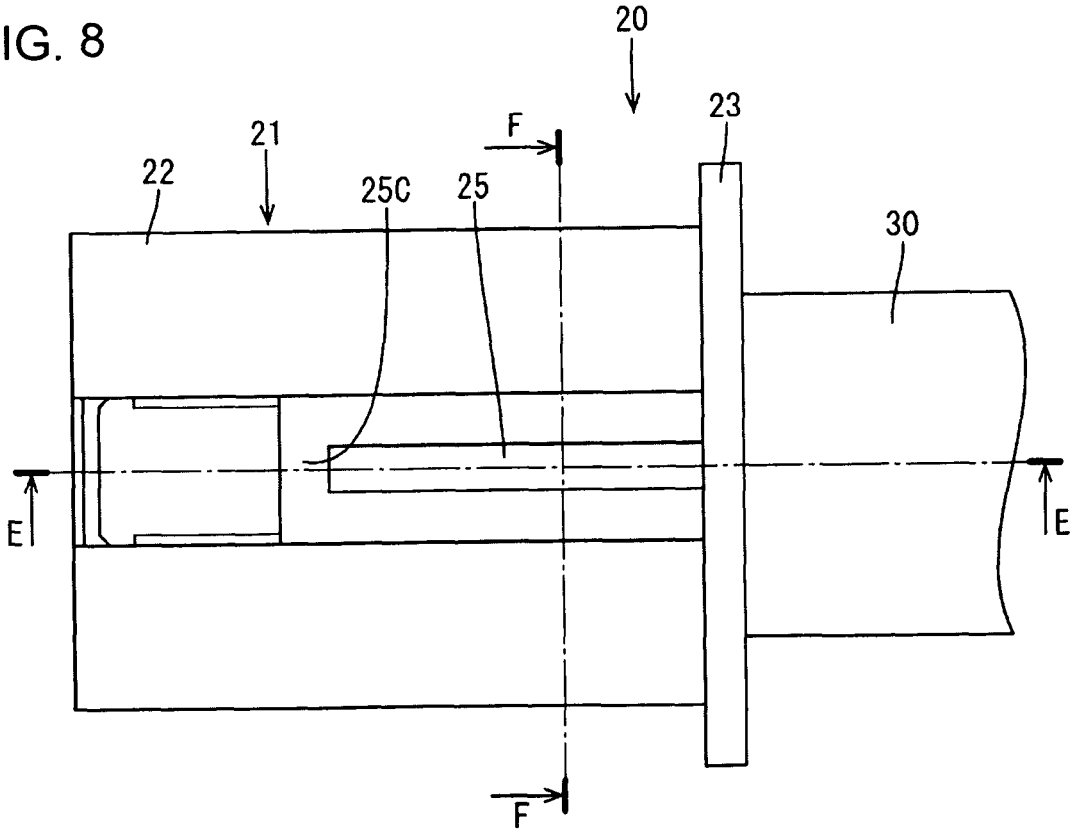
FIG. 8 is a plan view of a male connector.
Figure 9:
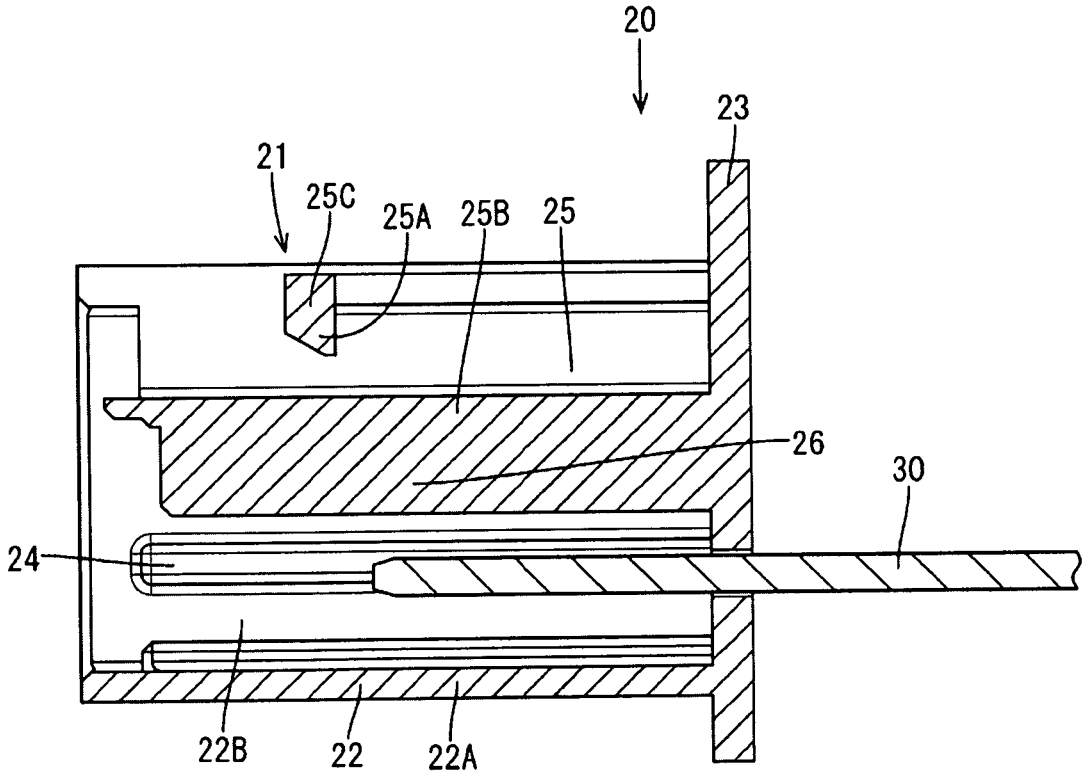
FIG. 9 is a section along E-E in FIG. 8.
Figure 11:
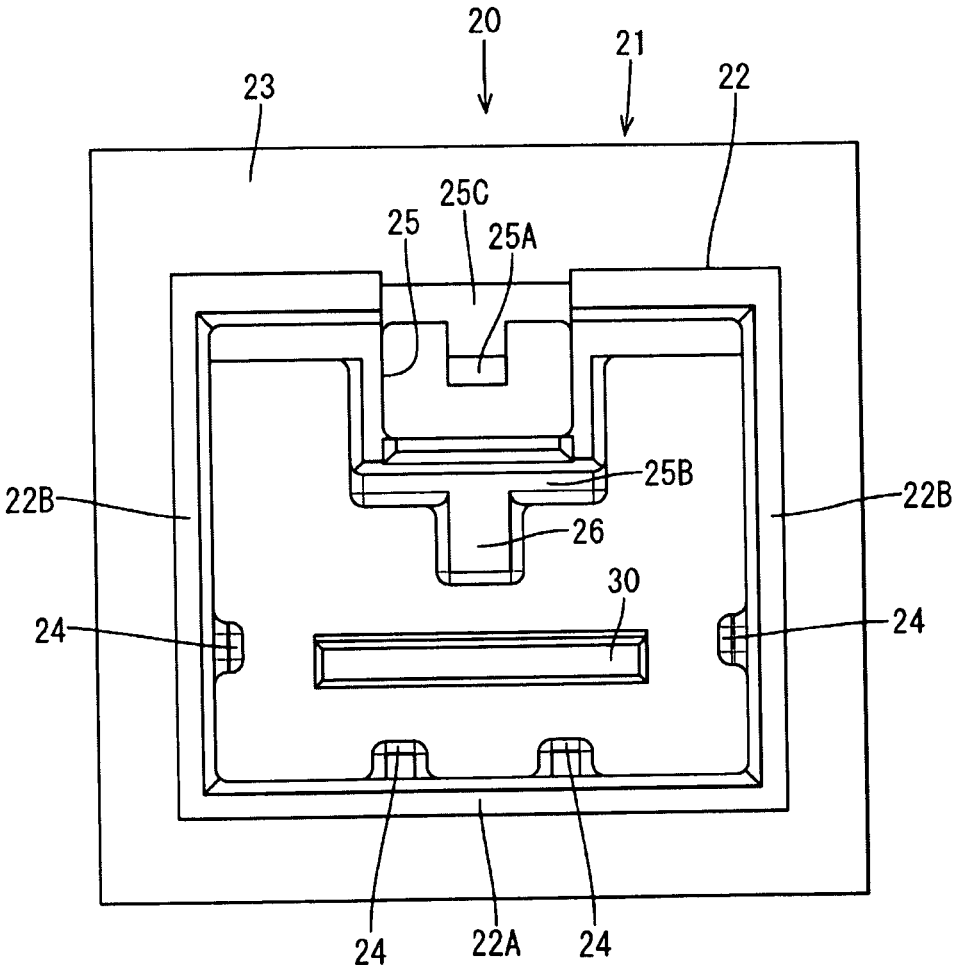
FIG. 11 is a front view of the male connector.

As shown in FIGS. 8 and 9, the male connector 20 includes a male housing 21 made of synthetic resin, and the male housing 21 is provided with a receptacle 22 open forward, and a base end wall 23. The receptacle 22 projects forward from the base end wall 23 and is substantially in the form of a rectangular tube, as shown in FIG. 11. A bottom wall 22A has two guide ribs 24 inside the receptacle 22, and both side walls 22B are also provided with two guide ribs 24 inside the receptacle 22.

A lock recess 25 is provided in a ceiling wall 22C of the receptacle 22 and is recessed down. The lock recess 25 is open up and a lock receiving portion 25A is provided in an upper end opening of the lock recess 25. The lock receiving portion 25A projects down from a linking portion 25C extending in the upper end opening of the lock recess 25. On the other hand, a protrusion 26 is provided on a bottom wall 25B of the lock recess 25. The protrusion 26 projects down from the lower surface of the bottom wall 25B of the lock recess 25.

Figure 10:
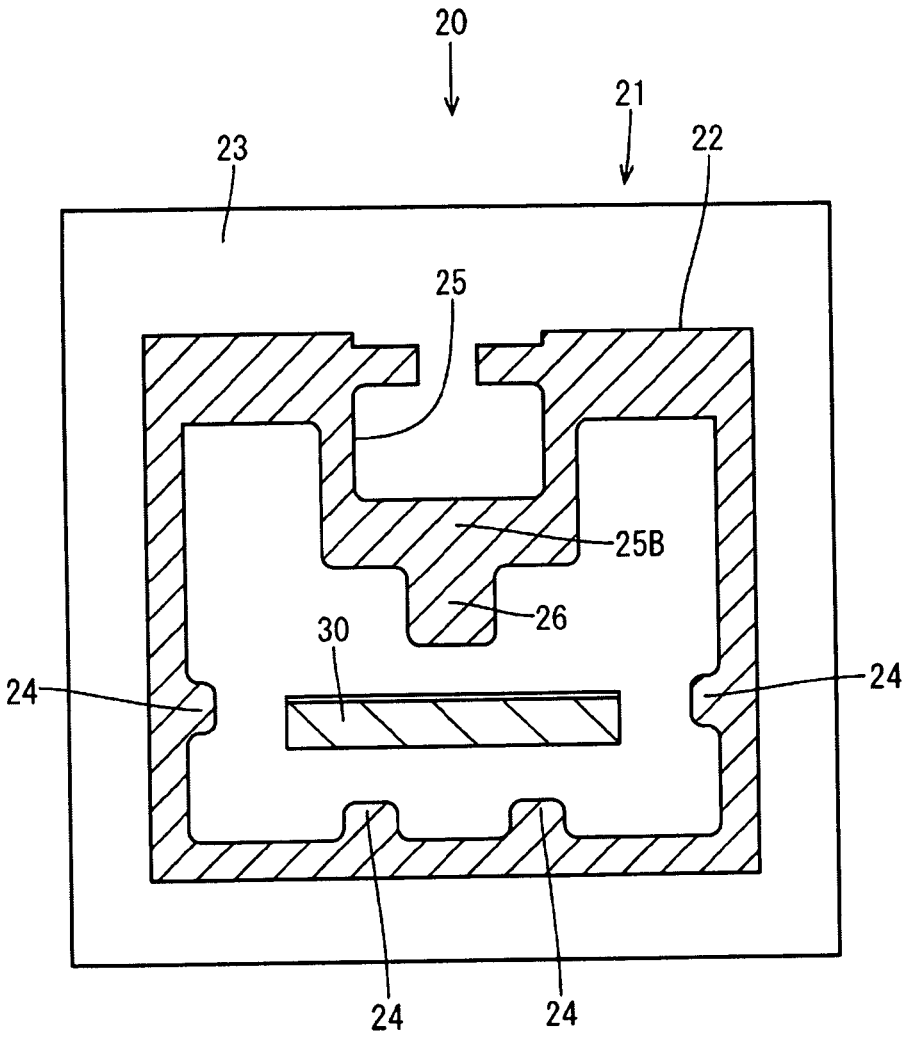
FIG. 10 is a section along F-F in FIG. 8.

A male terminal 30 is provided inside the receptacle 22. The male terminal 30 is disposed at a position surrounded from both upper and lower sides by the protrusion 26 and the two guide ribs 24 located below the protrusion 26 and surrounded from both left and right sides by the left and right guide ribs 24, as shown in FIG. 10. The male terminal 30 is a flat plate that penetrates through the base end wall 23 and projects forward from the base end wall 23, as shown in FIG. 9.

The front end of the male terminal 30 is located near a center of the receptacle 22 in the front-rear direction and located behind that of the protrusion 26. The front end position of the protrusion 26 is substantially the same as that of each guide rib 24 in the front-rear direction of the receptacle 22. In this way, a finger that approaches the male terminal 30 from the front contacts the front end of the protrusion 26 or the front end of the guide rib 24. Thus, the entrance of the finger is stopped and the finger cannot contact the male terminal 30.

If the protrusion 26 is not provided, the finger accordingly is inserted more easily deep into the receptacle 22. Thus, to avoid contact with the male terminal 30, the receptacle needs to be made longer in the front-rear direction and the male terminal 30 needs to be disposed at a more rearward position. In this respect, since the entrance of the finger is limited to the vicinity of the opening of the receptacle 22 and the receptacle 22 needs not be made longer in the front-rear direction in this embodiment by providing the protrusion 26, the receptacle 22 can be reduced in size and the male connector 20 can be reduced in size as compared to the case where the protrusion 26 is not provided.

As shown in FIGS. 4 to 7, the female connector 50 includes a female housing 51 made of synthetic resin, and a female terminal 60 is accommodated inside the female housing 51. A part of the female housing 51 where the female terminal 60 is accommodated inside serves as a female terminal accommodating portion 58. The female terminal accommodating portion 58 is fittable into the receptacle 22 of the male connector 20.

The female terminal accommodating portion 58 is in the form of a block long in the front-rear direction and a lock arm 52 is provided on the upper surface of the female terminal accommodating portion 58. A locking portion 52A is provided on a free end part of the lock arm 52 and is lockable to the lock receiving portion 25A of the male housing 20. Further, an unlocking portion 52B is provided on the lock arm 52 behind the locking portion 52A and is configured for unlocking the locking portion 52A from the lock receiving portion 25A. By pressing the unlocking portion 52B down, the locking portion 52A is displaced down and can be unlocked from the lock receiving portion 25A.

Figure 5:
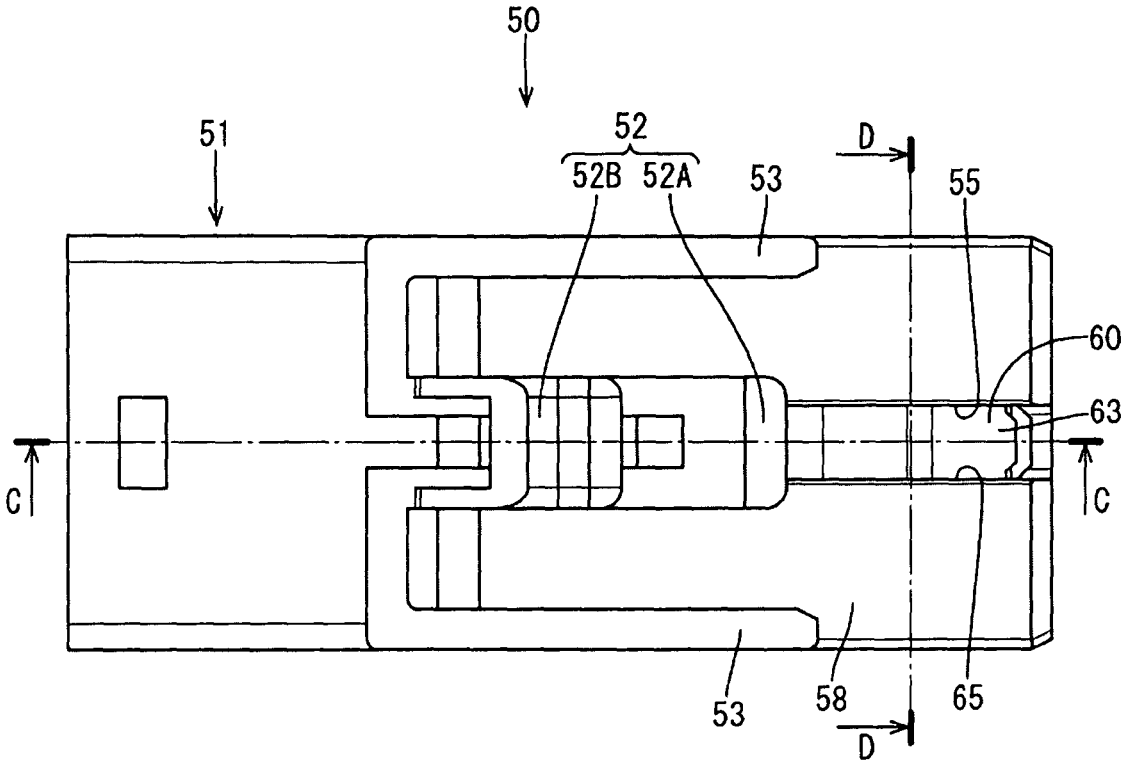
FIG. 5 is a plan view of the female connector.
Figure 6:
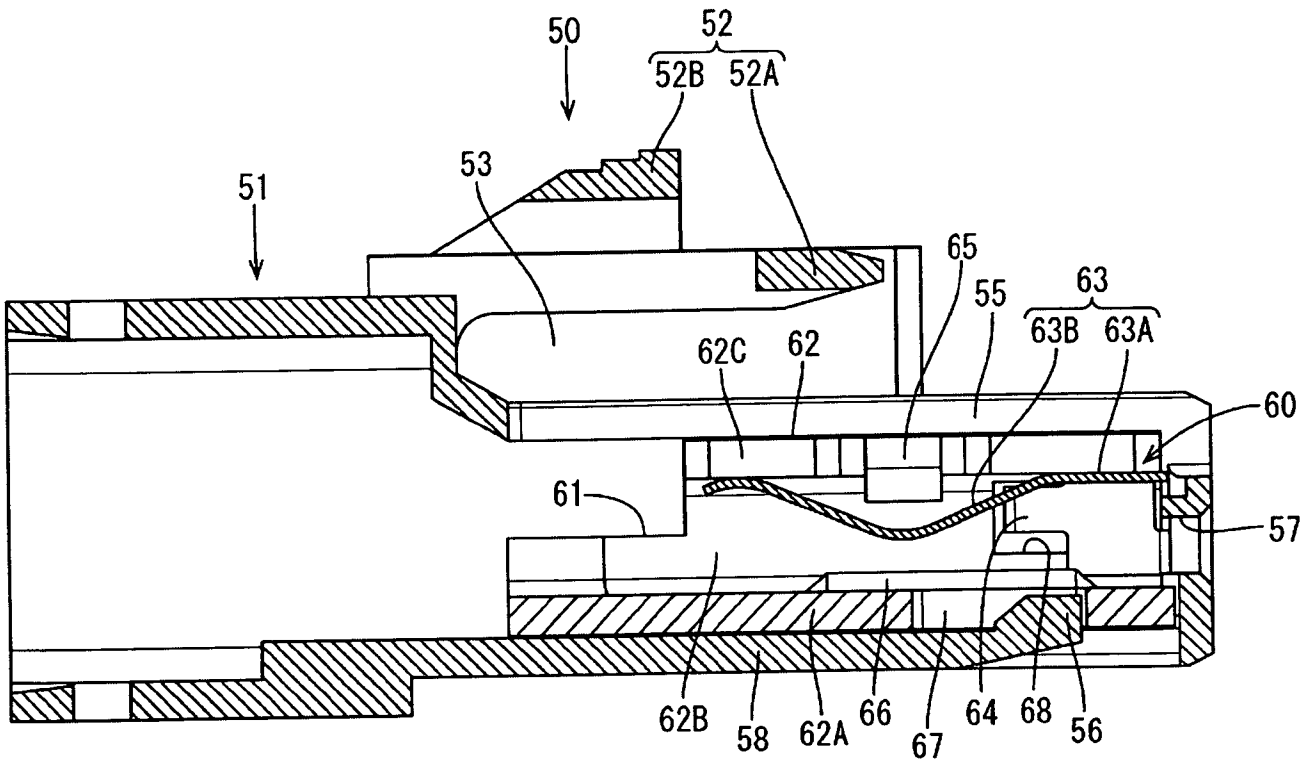
FIG. 6 is a section along C-C in FIG. 5.

As shown in FIG. 5, protection walls 53 are provided at both sides of the lock arm 52. The protection walls 53 project up from the upper surface of the female terminal accommodating portion 58 and extend in the front-rear direction. The front ends of the protection walls 53 are located before that of the lock arm 52 and, as shown in FIG. 6, the upper ends of the protection walls 53 are at the same height as the locking portion 52A of the lock arm 52 and below that of the unlocking portion 52B.

Further, a terminal insertion hole 57 is provided in the front surface of the female terminal accommodating portion 58 and the male terminal 30 can be inserted therethrough. Further, guide grooves 54 are provided by recessing the bottom surface of the female housing 51. One guide groove 54 also is provided in each side surface of the female housing 51. The guide ribs 24 are fit into the respective guide grooves 54 by fitting the female terminal accommodating portion 58 into the receptacle 22 of the male connector 20. Thus, if it is attempted to fit the female housing 51 in a vertically inverted posture into the receptacle 22, the guide ribs 24 cannot be fit into the respective guide grooves 54, thereby preventing erroneous connection.

Figure 12:
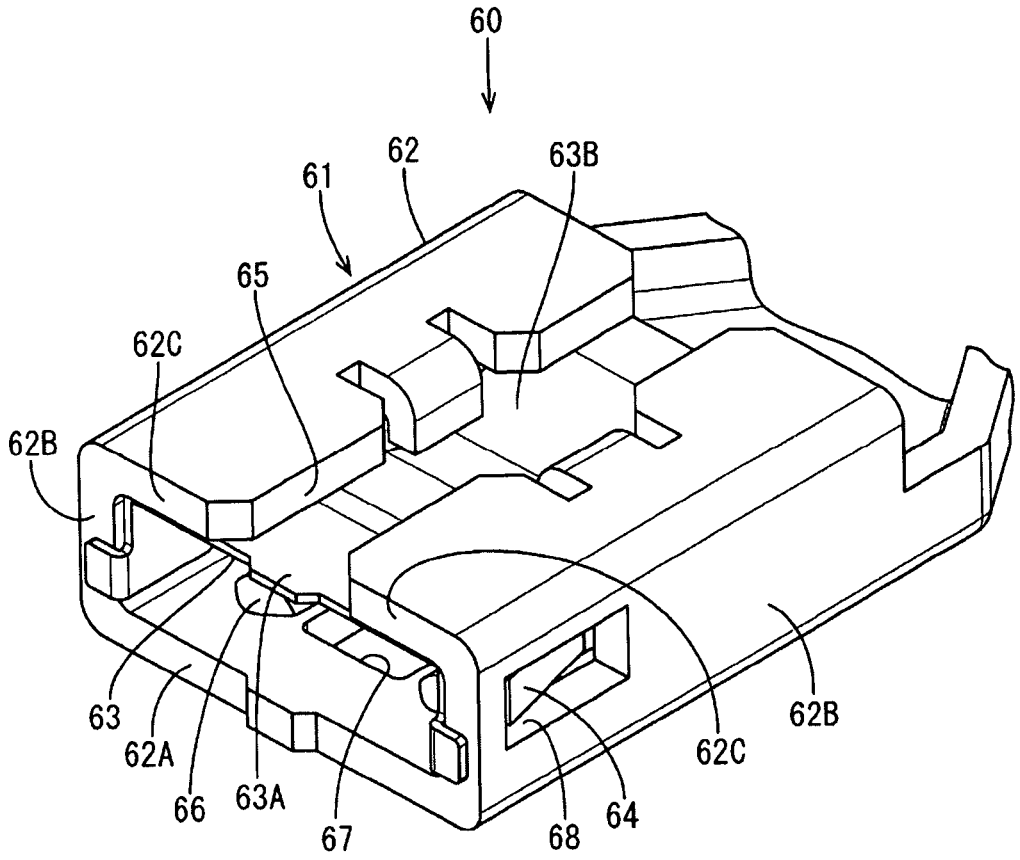
FIG. 12 is a perspective view of a female terminal.
Figure 13:
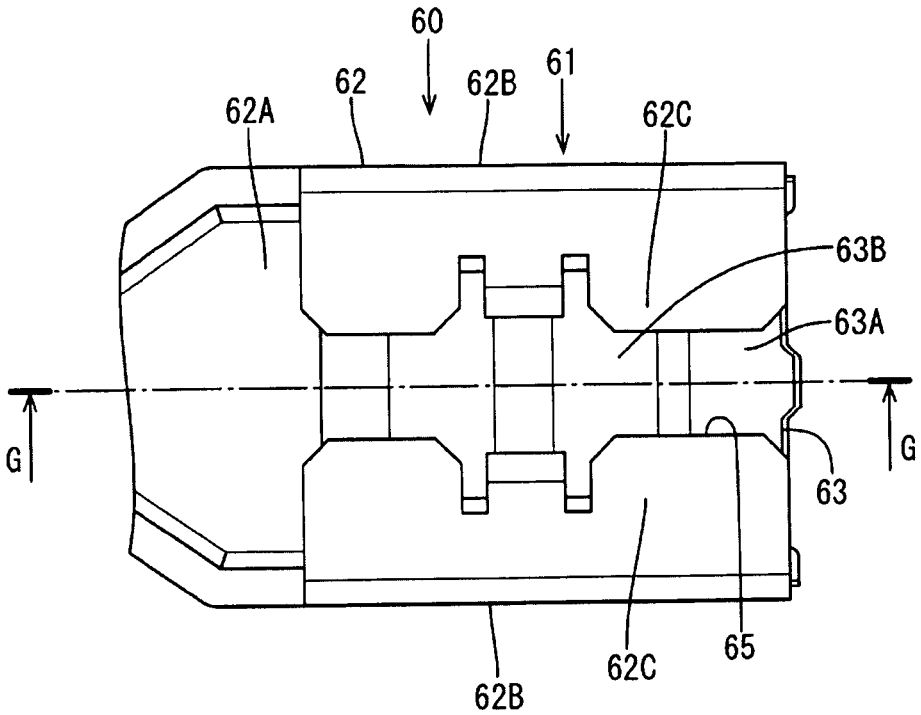
FIG. 13 is a plan view of the female terminal.
Figure 14:
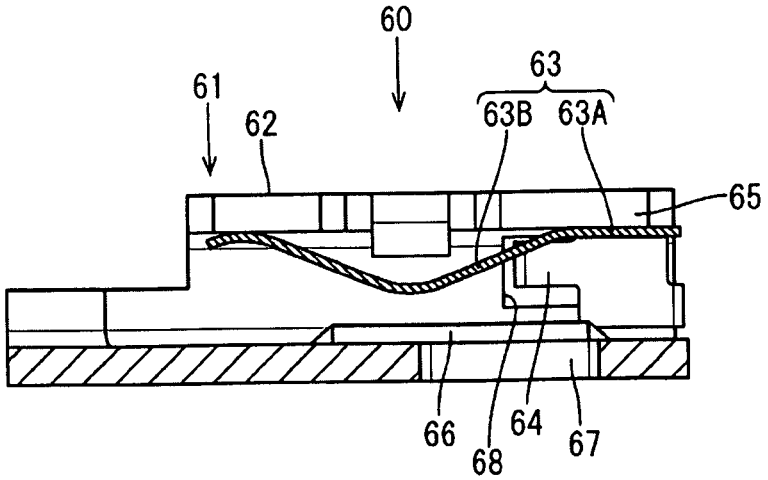
FIG. 14 is a section along G-G in FIG. 13.

As shown in FIG. 12, the female terminal 60 includes a connecting portion 61 to be connected to the male terminal 30. The connecting portion 61 includes a tubular rectangular tube 62 and a resilient member 63 disposed inside the rectangular tube 62.

The rectangular tube 62 includes a bottom wall 62A, two side walls 62B rising from both side edges of the bottom wall 62A and two ceiling walls 62C each extending from the upper edge of one side wall 62B toward the upper edge of the other side wall 62B. The ceiling walls 62C are disposed at a predetermined distance from each other and a space between the ceiling walls 62C serves as an escaping recess 65. That is, the escaping recess 65 penetrates through the rectangular tube 62 in a plate thickness direction.

The resilient member 63 includes a base plate 63A disposed along the inner surfaces (lower surfaces) of front end parts of the ceiling walls 62C and a spring portion 63B extending inward of the rectangular tube 62 from the rear edge of the base plate 63A toward a rear side while being substantially V-shaped. A plate thickness of the resilient member 63 is smaller than that of the rectangular tube 62. However, since metal (e.g. SUS) constituting the resilient member 63 has higher rigidity than metal (e.g. copper or copper alloy) constituting the rectangular tube 62, a sufficient contact pressure can be ensured even if the resilient member 63 has a smaller plate thickness than the rectangular tube 62.

Figure 7:
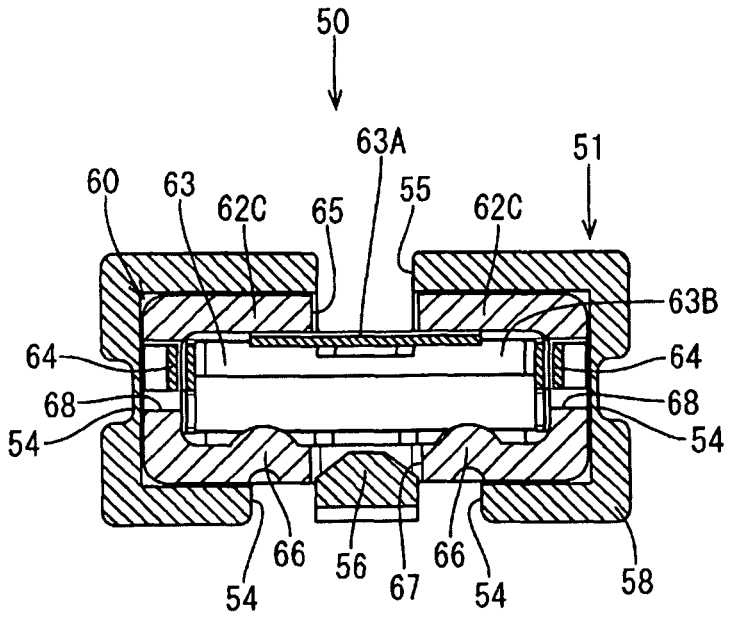
FIG. 7 is a section along D-D in FIG. 5.

As shown in FIG. 7, the resilient member 63 includes two retaining portions 64. One retaining portion 64 is disposed on each of the side edges of the base plate 63A. On the other hand, two retaining holes 68 are provided in the side walls 62B of the rectangular tube 62. By fitting and locking the retaining portions 64 into the retaining holes 68, the resilient member 63 is held inside the rectangular tube 62.

Further, two contact protrusions 66 are provided on the bottom wall 62A of the rectangular tube 62. The contact protrusions 66 extend in the front-rear direction while projecting toward the ceiling walls 62C. A lance hole 67 is provided between the contact protrusions 66 in the bottom wall 62A and is to be locked by a locking lance 56 in the female housing 51. The locking lance 56 is locked to an inner wall of the lance hole 67 to hold the female terminal 60 inside the female housing 51.

As shown in FIG. 2, the resilient member 63 presses the male terminal 30 down as the male terminal 30 is being fit into the connecting portion 61 of the female terminal 60. Thus, the male terminal 30 resiliently contacts the contact protrusions 66 of the female terminal 60 so that the male terminal 30 and the female terminal 60 are connected conductively. That is, the resilient member 63 functions as a biasing member for applying a contact pressure of the male terminal 30 and the female terminal 60, and electrical connection between the male terminal 30 and the female terminal 60 is made between the male terminal 30 and the two contact protrusions 66.

As shown in FIG. 7, a slit 55 is provided in the upper surface of the female housing 51 and the protrusion 26 of the male connector 20 is to be inserted therein. The slit 55 is provided from the front surface to the upper surface of the female housing 51 and penetrates through the female housing 51 in an in-out direction. A width of the escaping recess 65 matches that of the slit 55 of the female housing 51.

Further, inner side surfaces constituting the escaping recess 65 and those constituting the slit 55 are disposed along the vertical direction.

Figure 3:
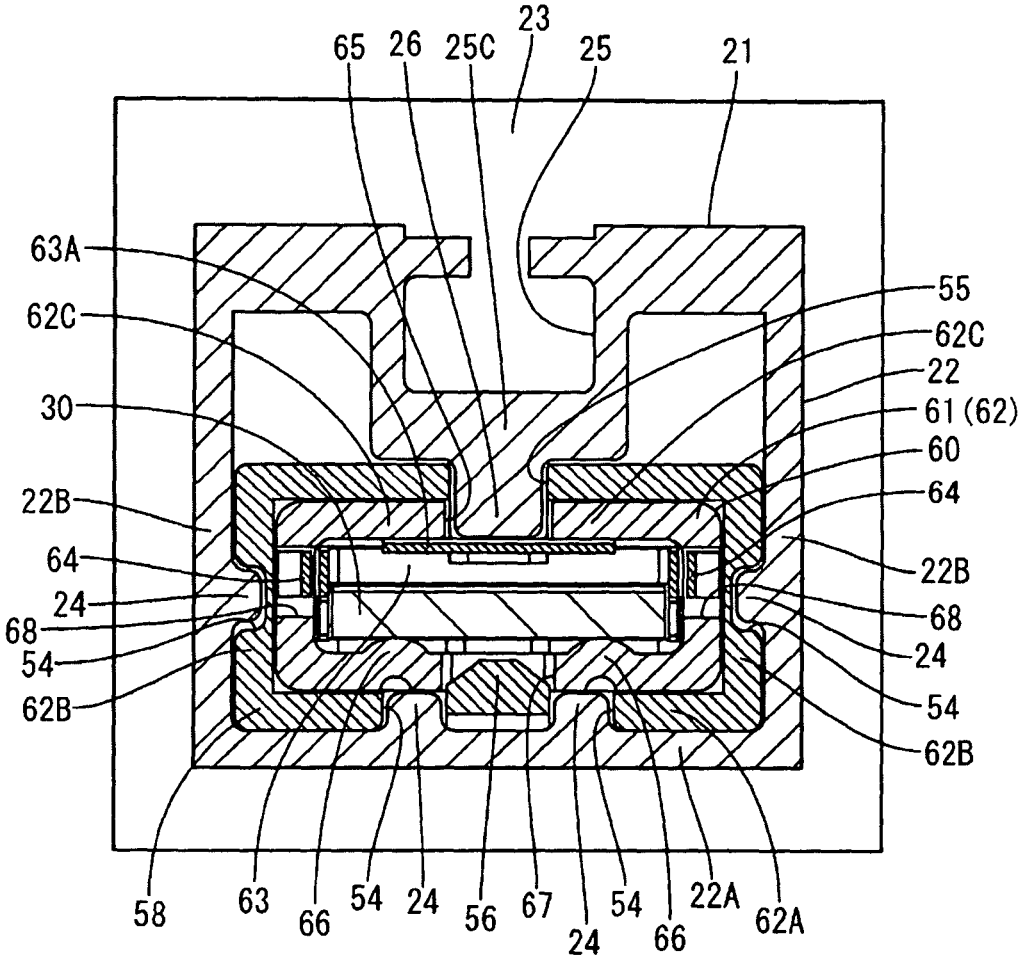
FIG. 3 is a section along B-B in FIG. 1.
Figure 4:
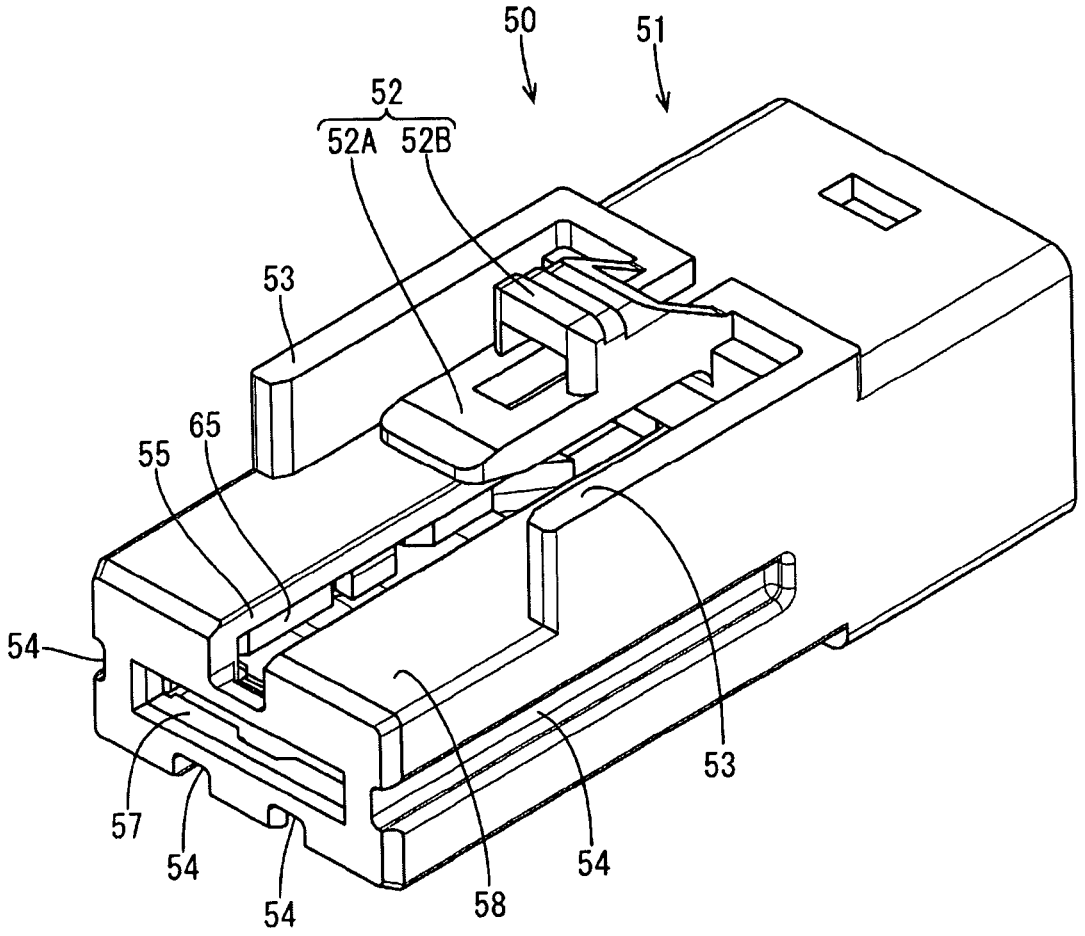
FIG. 4 is a perspective view of a female connector.

The base plate 63A of the resilient member 63 is disposed in a lower opening of the escaping recess 65. As shown in FIG. 3, when the protrusion 26 of the receptacle 22 of the male housing 21 enters the slit 55 and the escaping recess 65, the lower surface of the protrusion 26 is disposed to face the upper surface of the base plate 63A substantially without any clearance therebetween, but the protrusion 26 does not enter the female terminal 60. Thus, the protrusion 26 does not affect electrical connection between the male terminal 30 and the two contact protrusions 66.

As described above, the protrusion 26 is provided on the inner surface of the receptacle 22. Thus, the protrusion 26 interferes with a finger to provide a finger contact preventing measure provided. Further, when the male connector 20 and the female connector 50 are connected, the connectors are connected by the entrance of the protrusion 26 into the slit 55 and the escaping recess 65. Thus, the finger contact preventing measure can be provided without enlarging the male connector 20.

The connecting portion 61 may include the rectangular tube 62 and the resilient member 63 disposed inside the rectangular tube 62, and the escaping recess 65 may penetrate through the rectangular tube 62 in the plate thickness direction. According to this configuration, the rectangular tube 62 can be reduced in size as compared to the case where a rectangular tube portion is provided with a bottomed recess.

The resilient member 63 may include the base plate 63A disposed along the inner surface of the rectangular tube 62 and the spring portion 63B extending inward of the rectangular tube 62 from the base plate 63A, and the base plate 63A may be disposed in a one-end side opening of the escaping recess 65. According to this configuration, when the protrusion 26 enters the escaping recess 65, the base plate 63A prevents contact of the protrusion 26 with the spring portion 63B. Therefore the protrusion 26 cannot damage the spring 63B.

The invention is not limited to the above described and illustrated embodiment. For example, the following various modes are also included.

Although the resilient member 63 is provided separately from the rectangular tube 62 in the above embodiment, a resilient member may be integrally provided to a rectangular tube.

Although the base plate 63A is disposed in the lower opening of the escaping recess 65 in the above embodiment, the base plate 63A may be disposed along the bottom wall 62A of the rectangular tube 62.

LIST OF REFERENCE SIGNS

10 . . . connector
20 . . . male connector
21 . . . male housing
22 . . . receptacle
26 . . . protrusion
30 . . . male terminal
50 . . . female connector
51 . . . female housing
55 . . . slit
60 . . . female terminal
61 . . . connecting portion
62 . . . rectangular tube
63 . . . resilient member
63A . . . base plate
63B . . . spring
65 . . . escaping recess

The invention claimed is:

1. A connector with a male connector and a female connector connectable to each other, wherein:

the male connector includes a male terminal and a male housing having a receptacle and configured to hold the male terminal;

the female connector includes a female terminal having a connecting portion to be connected to the male terminal and a female housing having a female terminal accommodating portion fittable into the receptacle and configured to hold the female terminal;

a protrusion projecting toward the male terminal is provided on an inner surface of the receptacle;

the female terminal accommodating portion is provided with a slit into which the protrusion is to be inserted; and the connecting portion is provided with an escaping recess configured to allow the protrusion inserted into the slit and projecting inwardly of the female terminal accommodating portion to escape.

2. The connector of claim 1, wherein the connecting portion includes a tubular rectangular tube portion and a resilient member disposed inside the rectangular tube portion, and the escaping recess is provided to penetrate through the rectangular tube portion in a plate thickness direction.

3. The connector of claim 2, wherein the resilient member includes a base plate portion disposed along an inner surface of the rectangular tube portion and a spring portion extending inwardly of the rectangular tube portion from the base plate portion, and the base plate portion is disposed in a one-end side opening of the escaping recess.

* * * * *